US005091065A

United States Patent [19]

Tamamura

[11] Patent Number: 5,091,065

[45] Date of Patent: Feb. 25, 1992

[54] PROCESS FOR PREPARATION OF NEODYMIUM OR NEODYMIUM-IRON ALLOY

[75] Inventor: Hideo Tamamura, Chichibu, Japan

[73] Assignee: Showa Denko K.K., Tokyo, Japan

[21] Appl. No.: 530,772

[22] Filed: May 30, 1990

Related U.S. Application Data

[62] Division of Ser. No. 255,201, Aug. 23, 1988, Pat. No. 4,966,661.

[30] Foreign Application Priority Data

Dec. 23, 1986 [JP] Japan ..... 61-307308
Aug. 18, 1987 [JP] Japan ..... 62-204879
Sep. 3, 1987 [JP] Japan ..... 62-220893

[51] Int. Cl.[5] ..... C25C 3/34; C25C 3/36
[52] U.S. Cl. ..... 204/64 R; 204/71
[58] Field of Search ..... 204/64 R, 71

[56] References Cited

U.S. PATENT DOCUMENTS 3,729,397 4/1973 Goldsmith et al. ..... 204/71 X
4,684,448 8/1987 Itoh et al. ..... 204/71
4,737,248 4/1988 Nakamura et al. ..... 204/71
4,828,658 5/1989 Bertaud ..... 204/71

FOREIGN PATENT DOCUMENTS 0108474 5/1984 European Pat. Off. .
0184515 6/1986 European Pat. Off. .
59-46008 3/1984 Japan .
59-64739 4/1984 Japan .
61-87888 5/1986 Japan .
61-127884 6/1986 Japan .
61-159593 7/1986 Japan .
61-291988 12/1986 Japan .
62-63642 3/1987 Japan .

OTHER PUBLICATIONS

E. Morrice et al., Bur. Mine Rep Invest. No. 6957, 1967.
ENGLISH ABSTRACT OF JPA (KOKAI) 61-291988.

*Primary Examiner*—Donald R. Valentine
*Attorney, Agent, or Firm*—Sughrue, Mion, Zinn, Macpeak & Seas

[57] ABSTRACT

Provided is a fused salt electrolysis process for preparing neodymium or a neodymium alloy, especially a neodymium/iron alloy, which has a high purity and a reduced carbon content, at a low cost, a high current efficiency and a high productivity. According to this fused salt electrolysis process, by collecting the formed neodymium or neodymium alloy at the bottom of the bath and incorporating oxygen gas in the atmosphere above the bath, powdery carbon generated from the carbon electrodes is removed by oxidation and consumption and the electrolysis bath is stabilized. Furthermore, by using a plate-shaped electrode at least for the anode, the critical current density is increased and neodymium or a neodymium alloy can be formed at a high current density and a high current efficiency.

1 Claim, 11 Drawing Sheets

PROCESS FOR PREPARATION OF NEODYMIUM OR NEODYMIUM-IRON ALLOY

This is a division of application Ser. No. 07/255,201, filed Aug. 23, 1988, now U.S. Pat. No. 4,966,661.

BACKGROUND OF THE INVENTION (1) Field of the Invention

The present invention relates to a process for the preparation of neodymium or a neodymium alloy. More particularly, the present invention provides a process for preparing, at a low cost, high-purity neodymium or a high-purity neodymium/iron alloy, suitable as the starting material for an Nd-Fe-B type magnet which has recently attracted attention as a high-performance magnet.

(2) Description of the Related Art

A permanent magnet of the Nd-Fe-B system or Nd-Fe-Co-B system has recently been proposed as a relatively cheap high-performance permanent magnet (see Japanese Unexamined Patent Publication No. 59-46008 and Japanese Unexamined Patent Publication No. 59-64739). It is known that Nd used for the production of a permanent magnet of this type can be prepared by the calcium thermal reduction process or the fused salt electrolysis process (see, for example, Japanese Unexamined Patent Publication No. 62-63642). According to the calcium thermal reduction process, high-purity Nd can be obtained, but the process is defective in that the manufacturing cost is high. The present invention is directed to the production of Nd according to the fused salt electrolysis process.

The fused salt electrolysis process is roughly divided into a process using a chloride electrolysis bath and a process using a fluoride electrolysis bath. As the fused salt electrolysis process using a fluoride electrolysis bath, there is known the consumable electrode process for the production of an Nd/Fe alloy, in which iron is used as the cathode, carbon is used as the anode, the electrodes are formed to have a rod-like shape or a concentric shape, $Nd_2O_3$ is electrolytically reduced in an appropriate fused salt electrolysis bath, and a metallic neodymium is deposited on the cathode of iron to alloy neodymium with iron (E. Morris et al, U.S. Bur Min., Rep. Invest., No. 7146, 1968). Moreover, it is taught that there is a possibility that a fluoride of neodymium will be used as the starting neodymium compound (Morris et al, U.S. Bur. Min., Rep. Invest., No. 6957, 1967).

Furthermore, the fused salt electrolysis processes for the production of Nd are taught in Japanese Unexamined Patent Publication No. 61-159593, Japanese Unexamined Patent Publication No. 61-87888, and Japanese Unexamined Patent Publication No. 61-127884.

Generally speaking, however, the fused salt electrolysis process for the production of Nd is still at the first step of research and development, research has been made mainly on the laboratorial level, and the electrolysis process for the production of Nd has not been investigated on the commercial level. The present inventors are not aware of any reports concerning such investigations.

Under this background, the present inventors carried out research into the commercial-scale production of Nd by the fused salt electrolysis process, with a view to preparing same on an industrial scale and supplying Nd expected to be much in demand in the future as the starting material of a permanent magnet of the Nd-Fe-B system or Nd-Fe-Co-B system, and as a result, have now completed the present invention.

SUMMARY OF THE INVENTION

Therefore, a primary object of the present invention is to provide a fused salt electrolysis process for preparing high-purity Nd or a high-purity Nd alloy at a low cost on an industrial scale, to meet the demand for Nd as the starting material of a permanent negative alloy of the Nd-Fe-B system or Nd-Fe-Co-B system.

In accordance with the present invention, this object can be attained by a process for the preparation of neodymium or a neodymium alloy, which comprises arranging a plate-shaped carbon electrode as an anode and a plate-shaped metal or carbon electrode as a cathode in a fused salt electrolysis bath so that the electrodes confront each other in the electrolysis bath, covering the electrolysis bath with an atmosphere containing an oxygen gas at a concentration sufficient to oxidize and consume powdery carbon generated from the carbon electrode and floating on the surface of the electrolysis bath during the electrolysis, and performing the electrolysis to deposite neodymium or a neodymium alloy on the cathode and drop the neodymium or neodymium alloy below the cathode to collect the neodymium or neodymium alloy at the bottom of the electrolysis bath.

The first characteristic feature of the present invention is that the atmosphere on the electrolysis bath contains an oxygen gas. In the fused salt electrolysis process for the production of Nd by the conventional consumable electrode method as taught by E. Morris et al, since neodymium is active and tends to react with oxygen in the open air, to prevent the reaction of neodymium with oxygen and the oxidation of the electrode of C, Mo or W, it has been considered necessary to perform the electrolysis in an atmosphere of a protecting gas such as an inert gas, and thus the electrolysis has been carried out in such a protecting gas atmosphere. Therefore, it is necessary to seal the protecting gas at the electrolysis, and the process has a defect that the equipment cost is increased, supply of the starting material or repair of the apparatus is difficult, and the manufacturing cost is increased.

Since carbon is used for the electrode, this carbon reacts with an electrolysis reaction gas composed mainly of fluorine, and the carbon electrode is consumed. But, because of the atmosphere of protecting gas such as an inert gas, a part of the carbon electrode is converted to a powder to cover the surface of the electrolysis bath and form a short circuit between both electrodes, with the result that a discharge is caused through the powdery carbon and there arise such problems as a reduction of the current efficiency and fluctuation of the anode current density. Moreover, a part of the powdery carbon on the surface of the electrolysis bath migrates into the electrolysis bath and floats therein, and therefore, the electric conductivity of bath is changed to render the conditions of the electrolysis bath unstable and maintenance of the normal operation of electrolysis difficult. Moreover, the incorporated carbon is included in the produced alloy to degrade the quality of the produced alloy.

Incorporation of the carbon in the prepared alloy is a serious problem for the quality of the product. Since the product according to the above-mentioned process has a carbon concentration of several thousand ppm. In view of the fact that the allowable carbon concentration in Nd or an Nd/Fe alloy for an Nd magnet which has recently attracted attention is up to 400 ppm, the above product cannot be directly used as the starting material for the magnet.

Therefore, according to the present invention, a neodymium salt having a low melting point and a specific gravity smaller than that of Nd or an Nd alloy is used for the electrolysis bath (for example, a bath formed by adding lithium fluoride to neodymium fluoride), and Nd or the Nd alloy is collected in the lower portion of the electrolysis bath and Nd or the Nd alloy is covered by the electrolysis bath located above, whereby the obtained Nd or Nd alloy is isolated from the atmosphere above the electrolysis bath. Furthermore, by incorporating an oxygen gas into the atmosphere above the electrolysis bath, the powdery carbon generated from the carbon electrode is positively oxidized with the oxygen in the atmosphere and is removed into the atmosphere in the form of carbon compounds (CO and $CO_2$), and consumption of the deposited Nd or Nd alloy by the oxygen in the atmosphere can be prevented. Since the powdery carbon is lighter than the electrolysis bath and floats on the surface of the electrolysis bath, the oxygen in the atmosphere above the electrolysis bath is easily consumed for the oxidation. Furthermore, since the powdery carbon suspended in the electrolysis bath is lighter than the electrolysis bath, the powdery carbon is caused to rise to the surface of the electrolysis bath by a convection of the electrolysis bath, and at this point, the powdery carbon falls into contact with oxygen and is easily consumed for oxidation.

As is apparent from the foregoing description, according to the present invention, by incorporating oxygen in the atmosphere on the electrolysis bath, Nd or an Nd alloy (especially an Nd/Fe alloy) having a drastically reduced carbon content can be obtained and this Nd or Nd alloy has a high purity such that the Nd or Nd alloy can be directly used as the starting material for the production of a permanent magnet.

The oxygen gas concentration in the atmosphere on the electrolysis bath is sufficient if it allows that the powdery carbon generated from the carbon electrode and floating on the surface of the electrolysis bath is oxidized and consumed. The oxygen gas concentration is generally 10 to 40% by volume and preferably 15 to 30% by volume. If the oxygen concentration is lower than 15% by volume, the amount of the powder carbon is increased and this increase becomes conspicuous if the oxygen concentration is lower than 10% by volume, with the result that the normal operation becomes difficult and the carbon concentration in the deposited metal is drastically increased. If the oxygen concentration exceeds 30% by volume, oxidation consumption of the graphite electrode in the upper portion exposed from the bath surface is increased, and if the oxygen concentration exceeds 40% by volume, the consumption becomes vigorous and problems arise.

Since the oxygen concentration in the open air is included within the oxygen concentration range of the present invention, the electrolysis can be performed in the open air atmosphere according to the simplest embodiment. Moreover, an oxygen-enriched air atmosphere and an atmosphere formed by adding a necessary amount of oxygen to an inert gas can be used.

In a permanent magnet of the Nd-Fe-B system or Nd-Fe-Co-B system, the carbon content must be up to 400 ppm. This requirement can be satisfied in Nd or an Nd/Fe alloy prepared according to the present invention, and a carbon content lower than 200 ppm, and moreover, a carbon content lower than 100 ppm, can be easily realized.

The second characteristic feature of the process of the present invention resides in the shape and arrangement of the electrodes. As pointed out hereinbefore, a rod-shaped consumable electrode is used in the known fused salt electrolysis process for the production of Nd cr an Nd/Fe alloy. But, if rod-shaped consumable electrodes are used, the electrolysis reaction is advanced along the shortest distance between the cathode and anode, and the following problems arise with the consumption of the electrodes.

1) Since the current density changes with consumption of the electrodes, it is difficult to maintain an optimum current density. Moreover, the electrolysis current and electrolysis voltage are changed with the change of the current density, and it is also difficult to maintain optimum values of the electrolysis current and electrolysis voltage.

2) Since the current efficiency is changed with the change of the distance between the electrodes, it is difficult to maintain an optimum current efficiency.

3) The amount of the metal deposited in the fused salt electrolysis is determined by the quantity of the current according to Faraday's law. In the fused salt electrolysis, if a current exceeding a certain current density of the anode is caused to flow, the anode effect is produced and it becomes impossible to maintain normal electrolysis. Accordingly, the operation must be carried out at a current density lower than the critical current density causing the anode effect. But, when rod-shaped electrodes are used, the current density is locally increased and the current density changes with the consumption of the electrodes, and therefore, the operation must be carried out while controlling the current quantity having a direct relation to the output to a low level.

Because of the foregoing problems, it is very difficult to continue the operation constantly at optimum values.

Various experiments were conducted for solving the above-mentioned problems. According to the present invention, the problems were solved by adopting, in principle, a plate-like electrode shape where the electrolysis area is not substantially changed, instead of the conventional electrode shape, that is, the rod-like shape. Namely, when rod-shaped electrodes are used, since the electrolysis reaction is mainly advanced along the shortest distance between the electrodes, if the critical anode current density is reached only in the shortest distance region, the anode effect is produced. Moreover, even if the operation is carried out at a current density lower than the critical anode current density, the distance between the electrodes is increased with the consumption of the electrodes and the surface area of the electrodes is gradually decreased. Furthermore, consumption of the electrodes is not uniformly advanced on the surfaces of the rod-shaped electrodes, and the shorter the distance between the electrodes, the quicker the consumption of the electrodes. Accordingly, the rate of decrease of the surface area of the electrodes per unit time differs according to the diameter of the electrodes but is not constant, and thus it is difficult to correctly calculate the distance between the electrodes. The above-mentioned change of the current density with consumption of the electrodes is the first problem, and this change of the distance between the electrodes per unit time by consumption of the electrodes with the lapse of time is the second problem.

As is apparent from the foregoing description, when rod-shaped electrodes are used, the operation conditions are complicatedly changed with advance of the electrolysis and it is difficult to precisely calculate the state of the electrodes, and therefore, it is difficult to maintain optimum electrolysis conditions.

The first problem can be solved by adopting the electrodes such the shape that the electrolysis reaction area is not changed even with consumption of the electrodes. Regarding the change of the distance between the electrodes with the consumption of the electrodes, if an electrode shape is adopted such that the rate of the change of the distance between the electrodes per unit time is constant, by moving the electrodes at a constant speed corresponding to this changing rate, a constant distance between the electrodes can be simply maintained.

Based on this idea, according to the present invention, the above-mentioned problem can be solved by adopting, in principle, a plate-like shape such that the electrolysis reaction areas, that is, the areas of the confronting portions of the anode and cathode, are constant and large.

In the fused salt electrolysis, as pointed out hereinbefore, it is important that the electrolysis be carried out while inhibiting the anode effect, and therefore, it is important that the electrolysis reaction area on the surface of the anode be kept constant to appropriately control the current density of the anode. Accordingly, a desired effect can be attained even if plate-like electrode is used only for the anode, and the object of the present invention can be attained. An example of the electrode arrangement according to this embodiment is shown in FIGS. 1A and 1B.

Note, in FIGS. 1A, 1B, 2A, 2B, 3A, 3B, 4, 5A, and 5B, reference numeral 1 represents an electrolytic cell, reference numeral 2 represents an electrolysis bath, reference numeral 3 represents an anode, reference numeral 4 represents a cathode, reference numeral 5 represents a liquid drop of Nd or an Nd alloy, reference numeral 6 represents deposited Nd or a deposited Nd alloy, and reference numeral 7 represents a power source.

But, if a rod-like electrode is used for the cathode and a plate-like electrode is used for the anode, since the distance between the electrodes is different among respective parts of the surface of the anode, it cannot be considered that an optimum current density is attained on the entire surface of the anode. Therefore, the highest effect is attained if plate-like electrodes are used as both an anode and a cathode. An example of the electrode arrangement according to this embodiment is illustrated in FIGS. 2A and 2B. In this case, it may be considered that the current density is equal over the entire surface of the anode.

The present inventors carried out research with a view to developing a process capable of stable continuous electrolysis with a large quantity of an electric current by increasing the substantial reaction area of the anode without increasing the size of an electrolytic cell. When the portion surrounded by a solid line in the arrangement of plate electrodes shown in FIGS. 2A and 2B is compared with the arrangement of rod-like electrodes shown in FIGS. 5A and 5B based on the same electrode surface area in the bath, it is seen that the arrangement shown in FIGS. 2A and 2B has an additional space for increasing the size of the electrodes. Accordingly, if the size of the electrodes is increased as indicated by the broken line in the arrangement shown in FIGS. 2A and 2B, the surface area of the electrodes can be greatly increased and a large quantity of an electric current can be supplied. Therefore, if the arrangement shown in FIGS. 2A and 2B is adopted according to the present invention, the output can be increased to a level about 5 times as high as in the arrangement of the prior art shown in FIGS. 5A and 5B.

The inventors considered that, even if the shape and size of the anode are improved so as to supply a large quantity of an electric current, the increase of the electrodes is limited to the level indicated by the broken line in FIGS. 2A and 2B, and carried out research with a view to developing another process capable of supplying a large quantity of an electric current. Based on the knowledge that the quantity of the electric current for the electrolysis is determined by the current density on the anode rather than the current density on the cathode, the inventors created a process in which, by arranging two plate-shaped anodes on both sides of the cathode, instead of the arrangement of a pair of plate-shaped anode and cathode, the anode reaction area can be doubled in an electrolytic cell of the same size, and thus the output can be substantially doubled.

This process is effective for the fused salt electrolysis for the production of neodymium or a neodymium alloy including a neodymium/iron alloy where the cathode current density is not substantially limited but the anode current density is greatly restricted. Where cathode and anode having the same area are used, the current density on the cathode is 2 times the current density on each anode, and it is sufficient if the circuit is constructed so that the current from a rectifier is divided into halves and distributed to the two anodes, and the currents from the anodes join at the central cathode and merge into the rectifier. An example of this circuit is illustrated in FIG. 4.

As pointed out hereinbefore, according to the present invention, the cathode is arranged at the center and plate-shaped anodes are arranged to confront the cathode. Since the current density on the cathode is large, the shape of the cathode is not particularly critical, but the effect is enhanced if a plate-shaped cathode is used. An example of the arrangement of the electrodes is shown in FIGS. 3A and 3B.

In the fused salt electrolysis, as pointed out hereinbefore, it is very important that the distance between the electrodes be maintained at an appropriate value, but none of the prior art references discloses an optimum distance between the electrodes in the fused salt electrolysis. Accordingly, the inventors repeated experiments to find an appropriate the distance between the electrode, and as a result, found that the distance between the electrodes has a significant influence on the current efficiency and a high current efficiency can be maintained if the distance between the electrodes is adjusted to 10 to 50 mm.

To examine the influence of the distance between the electrodes on the current efficiency, electrolysis experiments were carried out by using a graphite electrode as the anode, a plate electrode of iron as the cathode, and an $LiF-NdF_3$ bath as the electrolysis bath. The results are shown in FIG. 6.

From the results shown in FIG. 6, it can be seen that, preferably, the distance between the electrodes is 10 to 50 mm, especially 20 to 40 mm. If the distance between the electrodes is smaller than 10 mm, an anion generated on the anode, such as $F^-(O^{2-}$ in the case where oxide $Nd_2O_2$ is decomposed), reacts with metallic neodymium formed on the cathode, and the metallic neodymium is converted to the neodymium compound again. If the distance between the electrodes is larger than 50 mm, deposition of metallic neodymium is inhibited by the diffusion effect of the electrolysis bath in the furnace.

The adjustment of the distance between the electrodes is accomplished by moving one or both of the electrodes with an advance of the electrolysis. In the case of rod electrodes, it is difficult to precisely calculate the distance between the electrodes, and it is also difficult to accurately perform the adjustment of the distance between the electrodes. In contrast, where plate-shaped electrodes are used as the cathode and anode, since only the electrode surfaces are changed two-dimensionally, an optimum distance between the electrodes can be easily maintained by moving one or both of the electrodes at a constant speed.

As pointed out hereinbefore, the most characteristic feature of the process of the present invention is that the fused salt electrolysis is carried out in an oxygen-containing atmosphere. In view of this feature, preferably a mixture of a fused salt having a specific gravity lower than that of the deposited metal, such as LiF, and a neodymium metal source are used as the fused salt bath. If LiF is used, the melting point of the electrolysis bath can be lowered, and since the specific gravity of LiF is lower than that of the deposited metal, the intended metal can be deposited below the electrolysis bath and can be isolated from the oxygen-free atmosphere. Moreover, since the specific gravity of the electrolysis bath is higher than that of released carbon, the released carbon is raised above the electrolysis bath and can be consumed by oxidation.

A fused salt of the $LiF-NdF_3$ system formed by adding $NdF_3$ as the neodymium metal source to LiF and a fused salt of the $Li-NdF_3-Nd_2O_3$ formed by further adding cheap $Nd_2O_3$ to the above system can be used as the fused salt. Furthermore, an appropriate amount of $BaF_2$, $CaF_2$ or the like may be added to these systems. Moreover, $NdCl_2$ can be used instead of $NdF_3$. LiF effectively lowers the melting point of the $NdF_3$ bath (for example, the melting point is lowered to 720° C. from 1420° C. if LiF is incorporated in an amount of 80 mole %) and improves the electroconductivity.

The fused salt of the $LiF-NdF_3$ system preferably comprises 96 to 65 mole %, especially 95 to 75 mole %, of LiF and 4 to 35 mole %, especially 5 to 25 mole %, of $NdF_3$. FIG. 7 through 10 illustrate changes of the critical anode current density and current efficiency observed when the composition of the $LiF-NdF_3$ system and the electrolysis temperature are changed. FIG. 7 through 10 also illustrate data obtained in the production of neodymium/iron alloys, and substantially similar results are obtained in the production of metallic neodymium. From the data shown in the drawings, it is seen that, if the composition is within the above-mentioned range, both the critical anode current density and the current efficiency are excellent. In the case of the $LiF-NdF_3-Nd_2O_3$ system, a composition formed by adding several % by weight of $Nd_2O_3$ to the above-mentioned preferred composition of the $LiF-NdF_3$ system is preferred.

The component to be consumed in the above-mentioned bath composition is supplied or replenished as the feed material according to the consumption rate. In the $LiF-NdF_3$ system or $LiF-NdF_3-Nd_2O_3$ system, $NdF_3$ is the main material, and it is sufficient if $Nd_2O_3$ or LiF is occasionally replenished according to the consumption rate. Where $Nd_2O_3$ is used, the amount of $Nd_2O_3$ should be within the solubility of $Nd_2O_3$ into the bath, that is, below 3% by weight.

To efficiently deposite the metal by electrolysis, it is important that the depth of the electrolysis bath covering the deposited metal be maintained at an appropriate level. In the present invention, the deposited metal is isolated from oxygen in the atmosphere by the electrolysis bath composed mainly of LiF lighter than the deposited metal. But, if the depth of the electrolysis bath is small, this isolating effect is insufficient. If the electrolysis is carried out, the vertical movement of the bath surface is caused by the generated anode gas, and therefore, a sufficient depth of the electrolysis bath should be determined while also taking this vertical movement of the bath surface into consideration. From the results of the experiments made by the inventors, it was found that the appropriate depth of the electrolysis bath should be at least 5 cm, preferably at least 10 cm. If the depth of the electrolysis bath is below this level, the isolating effect is insufficient and the electrolysis region is narrow, and therefore, the yield of the deposited metal is drastically reduced. In the process of the present invention, since the plate-shaped electrodes are longitudinally arranged in parallel to each other, as pointed out hereinbefore, the depth of the electrolysis bath inevitably exceeds 10 mm, and thus maintains effective areas for the electrodes. Accordingly, the depth of the bath does not, in practice, become a problem in the present invention.

Where metallic neodymium is prepared, carbon electrodes are used for both anode and cathode, but where a neodymium alloy, for example, a neodymium/iron alloy, is prepared, a carbon electrode is used for the anode and an iron electrode is used for the cathode. When metallic neodymium is prepared, only the anode is a consumable electrode, and when a neodymium alloy is prepared, both the electrodes are consumable electrodes. If an alloy of neodymium and other metal is prepared, this metal is used for the cathode.

A graphite electrode is generally used as the carbon electrode and is preferred from the viewpoint of oxidation resistance. But, a carbon electrode having a low graphitization ratio also can be used. High-purity iron such as electrolytic iron is preferred as the iron electrode, but the process of the present invention is advantageous in that, even if mild steel having a relatively low carbon content is used, a high-purity Nd/Fe alloy can be obtained.

For example, in the production of an Nd/Fe alloy, the following reaction is caused on the cathode to form an Nd/Fe alloy:

$$Fe+Nd^{3+}+3e^{-}\rightarrow Nd/Fe\ alloy\ \downarrow$$

On the other hand, carbon is consumed on the anode according to the following reaction, though the reaction in the oxide electrolysis differs from the reaction in the fluoride electrolysis.

Oxide electrolysis:

$$C+2O^{2-}\rightarrow CO_2+4e^{-}$$

$$C+O^{2}\rightarrow CO+2e^{-}$$

Fluoride electrolysis:

$$nC+mF^{-}\rightarrow C_nF_m+me^{-}$$

in which $C_nF_m$ stands for $CF_4$, $C_2F_6$, $C_3F_8$ or the like.

Where water is contained in the atmosphere gas, the above-mentioned fluorine reacts with water to form HF as indicated below:

$$F_2+H_2O \rightarrow 2HF+\tfrac{1}{2}O_2$$

In the production of metallic Nd, the following reaction takes place on the cathode to form metallic Nd, while carbon is consumed on the anode by the same reaction as caused on the anode in the case of the fluoride electrolysis:

$$Nd^{3+}+3e^- \rightarrow Nd \downarrow$$

The oxidation consumption of the electrode in the portion exposed to the atmosphere above the bath is effectively prevented by known oxidation-preventing methods, such as use of a graphite electrode having a high graphitization ratio, coating of the electrode surface with a metallic or ceramic coating material or coating of the electrode surface with a sleeve. In the production of a neodymium/iron alloy, since graphite of the anode is a consumable electrode, the graphite electrode can be directly used if conditions are selected such that the speed of consumption by the electrolysis reaction in the bath is higher than the speed of consumption by oxidation above the bath. In the production of metallic Nd, since Nd is deposited on graphite of the cathode, the carbon concentration in the formed metal is increased, but increase of the carbon concentration can be prevented by coating the reaction surface of the cathode graphite with a metal not forming an alloy with neodymium, such as Ta or Pt.

The third characteristic feature of the process of the present invention is that the electrolysis can be performed at a high anode current density and a high current efficiency. According to the process of the present invention, the electrolysis can be carried out stably at a high anode current density of at least 0.5 A/cm$^2$, preferably at least 0.7 A/cm$^2$, especially preferably at least 1.0 A/cm$^2$. Furthermore, in the process of the present invention, the electrolysis can be carried out at a high current efficiency of at least 70%, preferably at least 80%, especially preferably at least 85%. The reason why the operation can be carried out at such a high anode current density and current efficiency as mentioned above is that the shape and arrangement of the electrodes are improved as mentioned above, the floating or suspended powdery carbon is removed by the oxygen-containing atmosphere and furthermore, the composition and temperature of the bath are optimized. In the instant specification, the anode current density is the value obtained by dividing the average current of the anode by the area of the anode, and the area of the anode is the area of the portion, confronting the cathode, of the anode. Furthermore, the current efficiency is the value obtained by dividing the quantity of the formed metal by the theoretical electrolysis quantity determined from the supplied current according to Faraday's equation.

In the production of metallic Nd, the temperature of the electrolysis bath may be lower or higher than the melting point of metallic Nd or may be a temperature between the melting point of the fused salt and the melting point of metallic Nd. For example, if the electrolysis is carried out at a bath temperature lower than the melting point of Nd, needles of Nd are formed on the surface of graphite, but since Nd is heavier than the fused salt, Nd is deposited in the fused salt below the electrode. Where Nd is deposited in the form of needles and crystals extend to the anode, a short circuit is formed between the crystals and the anode and a large current flows, with the result that the crystals are fused and Nd is deposited below the electrode. Accordingly, even if the bath temperature is higher than the melting point of Nd or a temperature between the melting point of the fused salt and the melting point of Nd, the electrolysis can be carried out.

In the production of an Nd/Fe alloy, since the melting point of the Nd/Fe alloy is 640° C. at an Nd content of 75 mole % as shown in the phase diagram of Nd-Fe, which is lower than the eutectic point of 720° C. in the phase diagram of LiF-$NdF_3$, if the temperature of the electrolysis bath is maintained at a level higher than the melting point of the electrolysis bath, the Nd/Fe alloy deposited on the cathode is rendered liquid after the deposition, and since the alloy is heavier than the fused salt, the alloy is deposited in the fused salt below the electrode. Furthermore, the composition of Nd/Fe can be controlled by controlling the electrolysis temperature.

Accordingly, if the temperature of the electrolysis bath is higher than the melting point of the electrolysis bath, the electrolysis is possible, and a bath temperature slightly higher than 720° C., for example, a bath temperature of 750° C. or higher, is sufficient but a bath temperature of 750° to 1100° C. is preferred. Nevertheless, if the temperature of the electrolysis bath is elevated, consumption of the electrode by oxidation is increased and damage of the electrolytic cell material is promoted. Furthermore, from FIGS. 7 through 10 illustrating the relationship among the temperature of the electrolysis bath, the critical anode current density, the current efficiency, and the bath composition, it is seen that, if the bath temperature is too low or too high, the current efficiency is reduced and the anode critical current density is greatly changed. In view of the foregoing, it is recognized that an electrolysis bath temperature of 825° to 1000° C. is economically advantageous.

The temperature of the electrolysis bath can be controlled only by heat generated by the current flowing between the electrodes. The internal heating method is often adopted in the conventional fused salt electrolysis process, but in the process of the present invention, it is preferable to adopt the external heating method in which the bath temperature is controlled by heating equipment or element disposed outside the electrolysis bath. In the process of the present invention, since the current efficiency and the electric conductivity are high, if it is intended to supply heat sufficient to maintain the bath temperature at a certain level only by the current flowing between the electrodes, the distance between the electrodes must be increased, and it is feared that the operation will not be performed under optimum electrolysis conditions. Therefore, the external heating method is adopted in the present invention. Moreover, if the external heating method is adopted, the fused state can be maintained in the bath even when the electrodes are taken out of the bath for exchange or repair, and the operation can be easily started again and the production can be easily adjusted.

It is sufficient if the electrolytic cell is anti-corrosive under the composition and conditions of the bath used, but an electrolytic cell composed of an austenitic stainless steel [Japanese Industrial Standard (JIS) SUS-304, SUS-316 or SUS-310S] is preferred because the cell is cheap and has a high resistance to the fused salt.

In connection with the corrosion resistance of the electrolytic cell, metallic Nd or an Nd alloy such as Nd/Fe is likely to form an alloy with iron or other metal, and a vessel (receiver) for receiving Nd or the Nd alloy must be composed of a material which substantially does not form an alloy, such as tantalum, tungsten or molybdenum, and as a result of research by the inventor, it was confirmed that tantalum is most preferred. Since the metal such as tantalum is expensive, the receiver may be lined with tantalum or the like only in the portion falling in contact with Nd or the Nd alloy. But, even if only the surface of the receiver is lined with tantalum or the like, when the size, especially the width, of the electrodes is increased, the size of the receiver is inevitably increased and the amount used of tantalum or the like is inevitably increased. In the production of an Nd alloy such as Nd/Fe, if the bottom side of the plate-shaped cathode is inclined to form a projecting top edge so that liquid drops are collected from this projecting top edge and the formed alloy is dropped from the projecting top edge, the necessary size of the receiver can be diminished. It is sufficient if the lower end of the cathode is tapered so that liquid drops are collected at one point without a dispersed falling of the liquid drops or remaining of the liquid drops. A straight taper or a slightly expanded taper with a tapering angle of 10° to 30° is preferred. The point of the taper, that is, the point from which liquid drops fall, may be located at the center of the electrode, at the end of the electrode, or at an intermediate position. Namely, the position of the top end of the taper may be appropriately set according to the position of the metal receiver and the subsequent recovery method.

The Nd or Nd alloy collected in the receiver or in the bottom portion of the electrolytic cell may be directly collected from the receiver or electrolytic cell through a metal withdrawal opening formed in the wall of the electrolytic cell, but the Nd or Nd alloy can be simply collected according to a method in which a pipe introduced into the electrolysis bath or receiver from above the electrolysis bath and the metal is sucked up under vacuum through the pipe.

INDUSTRIAL APPLICATION

Since the process of the present invention is characterized in that the carbon content in obtained neodymium or an obtained neodymium alloy, especially a neodymium/iron alloy, is low and the productivity is high, the process of the present invention is very suitable for the industrial production of the starting material of a permanent magnet of the Nd-Fe-B system or Nd-Fe-Co-B system.

BRIEF DESCRIPTION OF THE DRAWINGS

FIGS. 1A and 1B, 2A and 2B, and 3A and 3B are diagrams illustrating electrode arrangements adopted in the present invention, in which FIGS. 1A, 2A, and 3A are plane views and FIGS. 1B, 2B, and 3B are sectional views;

DESCRIPTION OF THE PREFERRED EMBODIMENTS

Figure 1A:
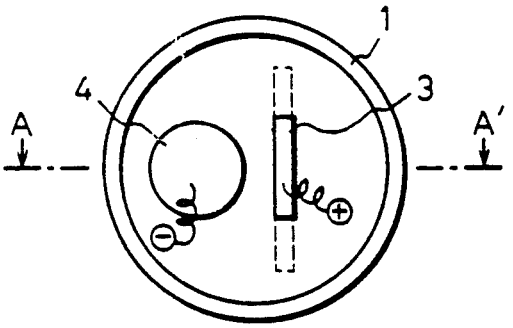
Figure 1B:
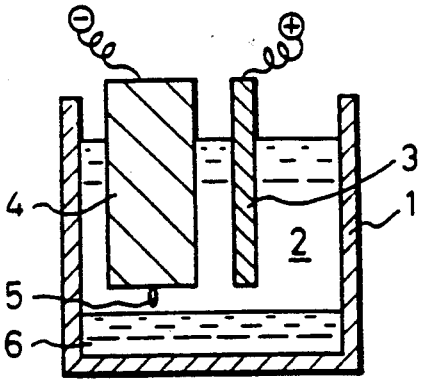
Figure 2A:
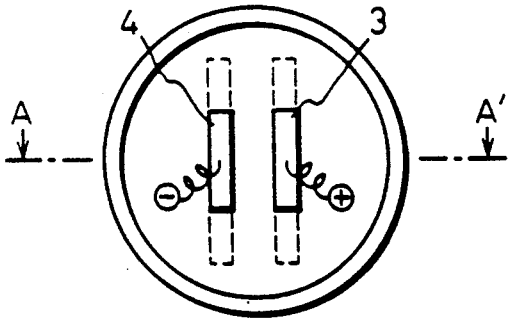
Figure 2B:
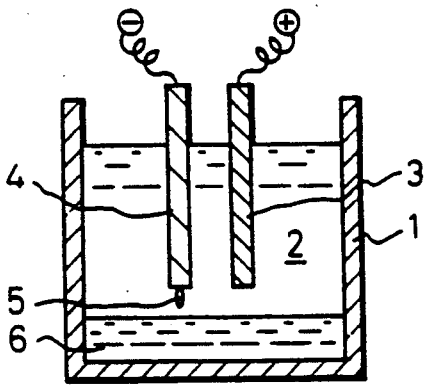
Figure 3A:
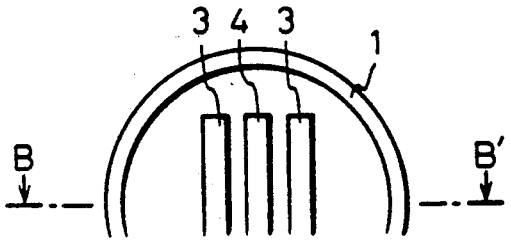
Figure 3B:
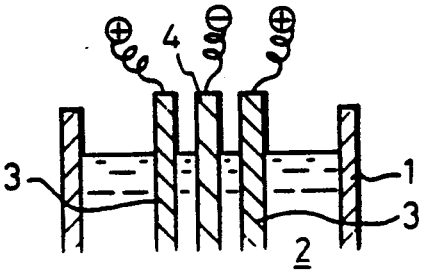
Figure 4:
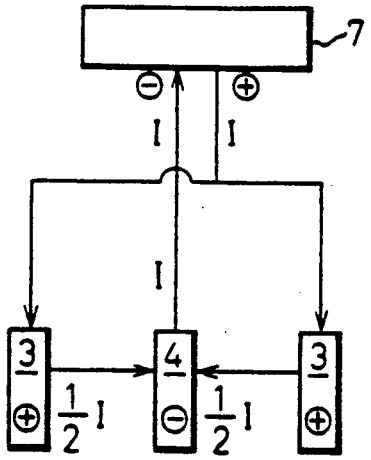
FIG. 4 is a power circuit diagram in an embodiment corresponding to FIGS. 3A and 3B in the present invention.
Figure 5A:
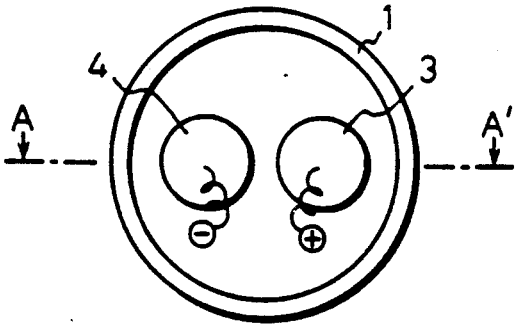
Fig.5A PRIOR ART
FIGS. 5A and 5B are plane and sectional views illustrating the conventional electrode arrangement.
Figure 5B:
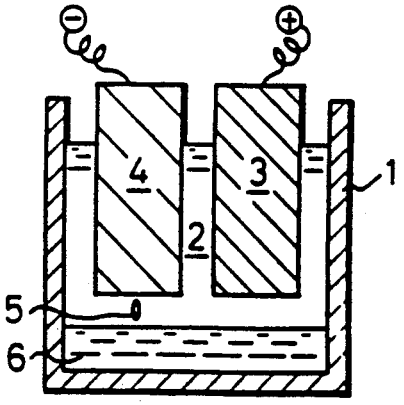
Fig.5B PRIOR ART
Figure 6:
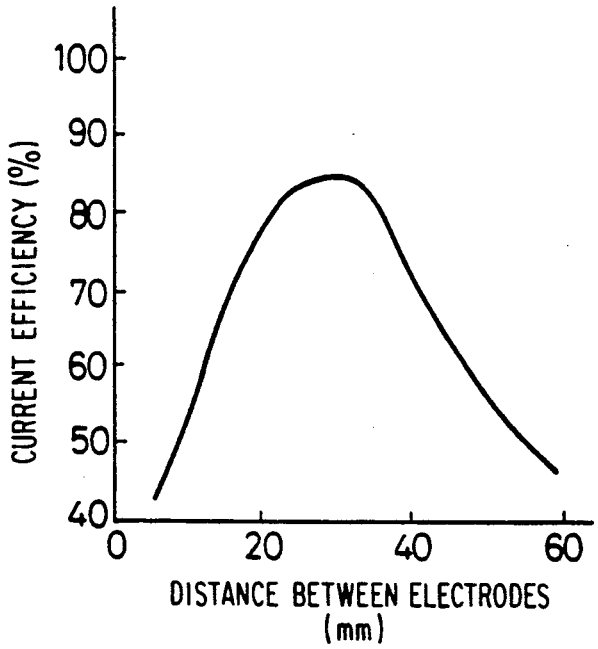
FIG. 6 is a diagram illustrating the relationship between the distance between the electrodes and the current efficiency.
Figure 8:
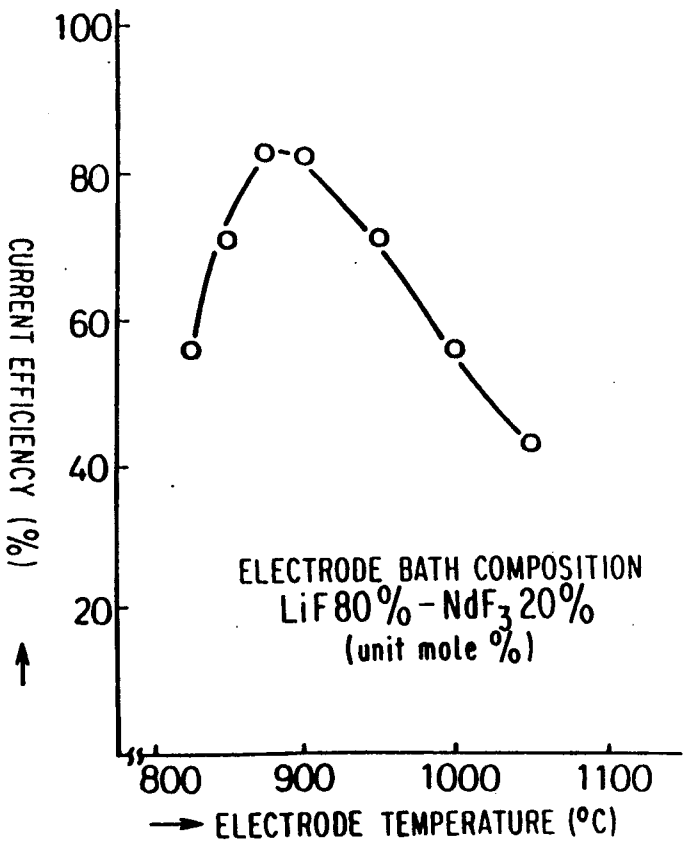
FIG. 8 is a diagram illustrating the relationship between the electrolysis temperature and the current efficiency in an $LiF/NdF_3$ bath.
Figure 7:
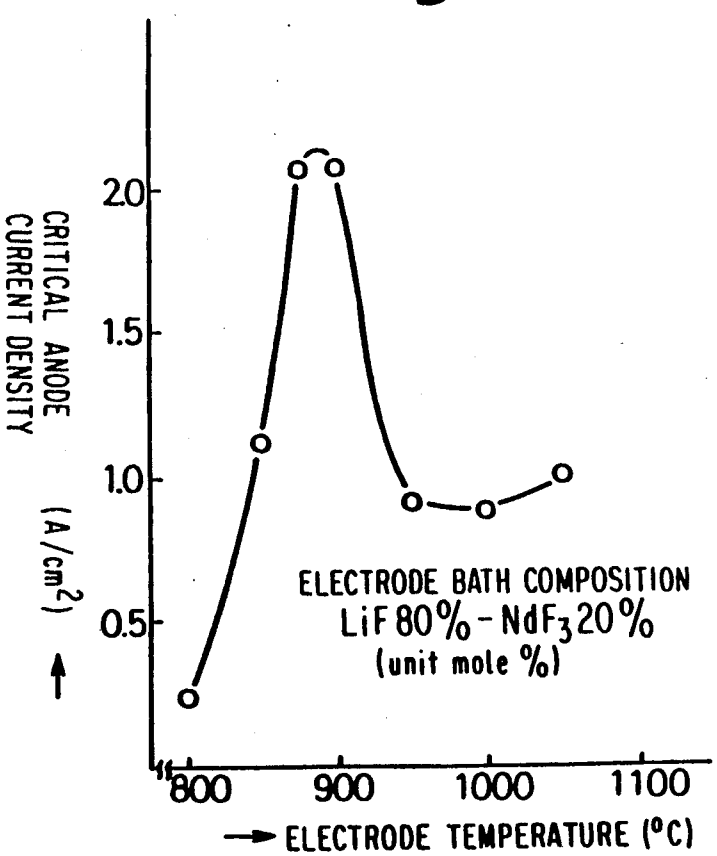
FIG. 7 is a diagram illustrating the relationship between the electrolysis temperature and the critical anode current density in an $LiF/NdF_3$ bath.
Figure 10:
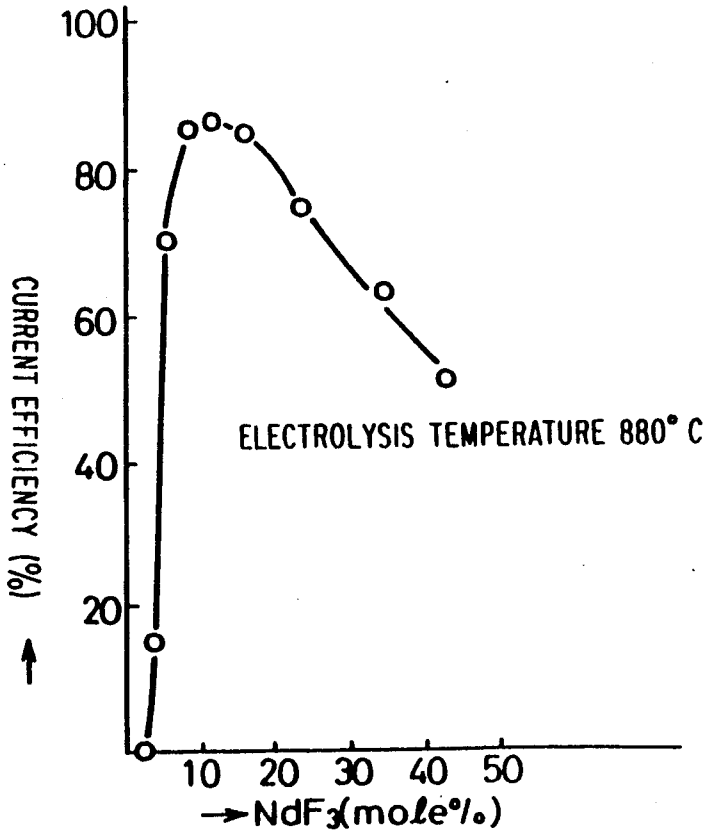
FIG. 10 is a diagram illustrating the relationship between the bath composition and the current efficiency in an $LiF/NdF_3$ bath.
Figure 9:
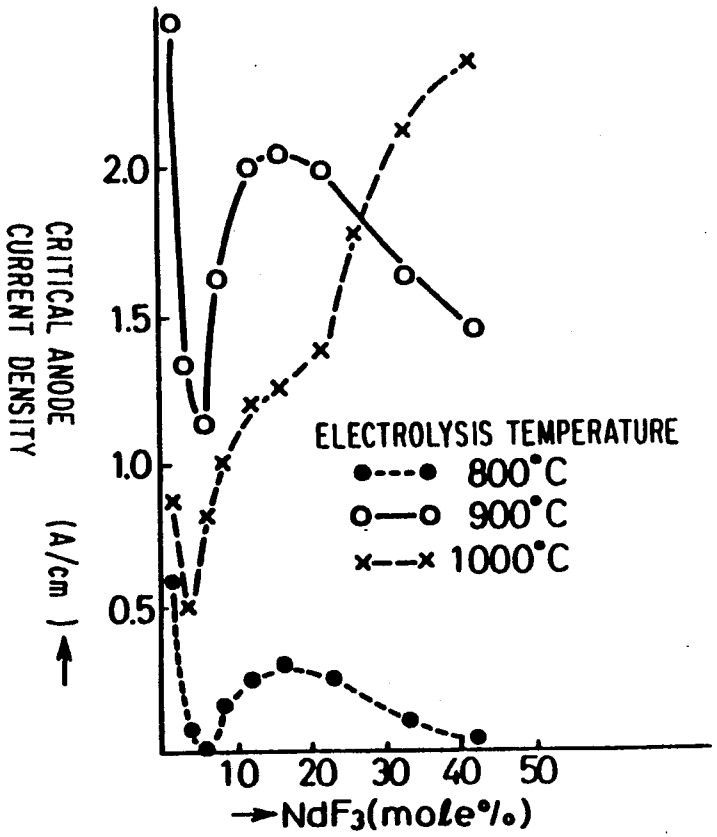
FIG. 9 is a diagram illustrating the relationship among the bath composition, the electrolysis temperature, and the critical anode current density in an $LiF/NdF_3$ bath.
Figure 11A:
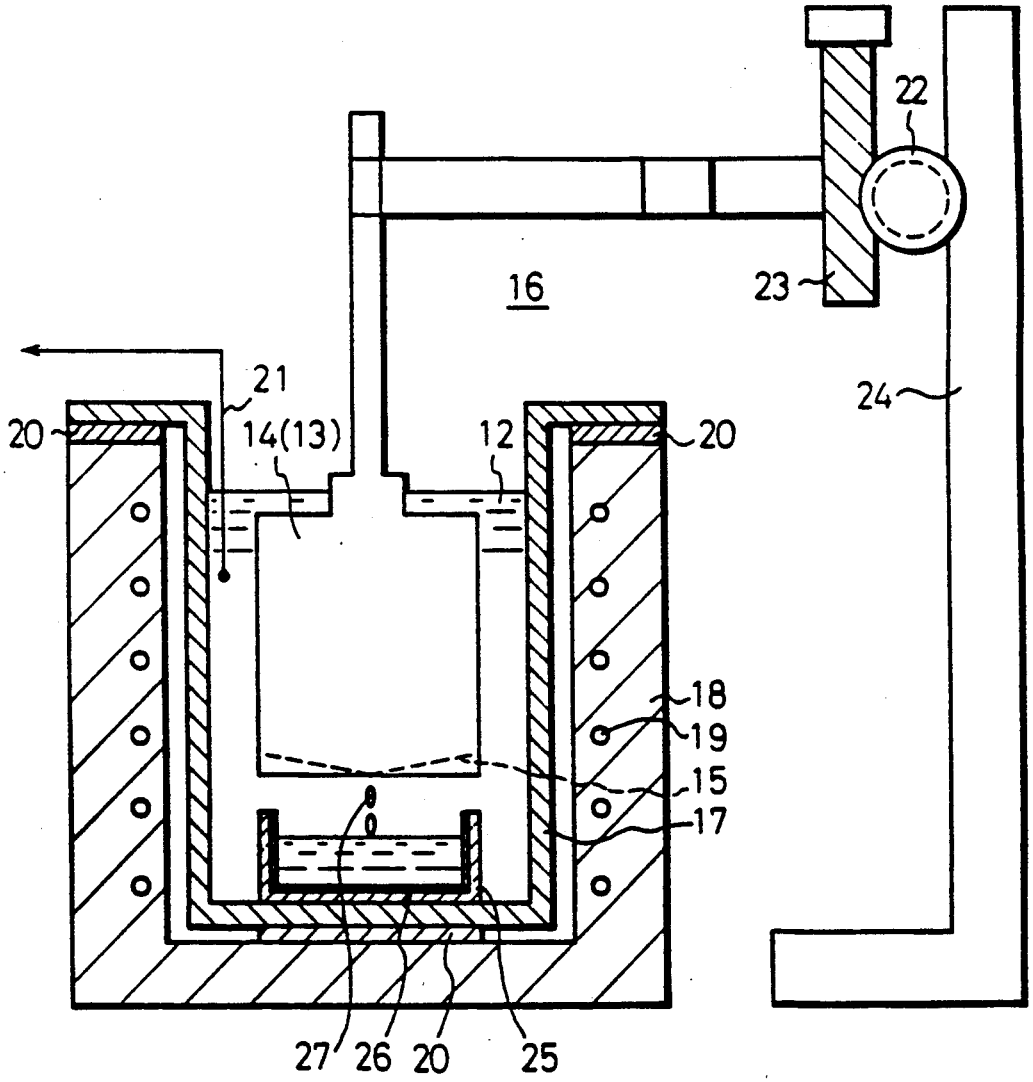
FIGS. 11A and 11B are longitudinally sectional and plane views illustrating diagrammatically an electrolysis apparatus for use in carrying out the process of the present invention.
Figure 11B:
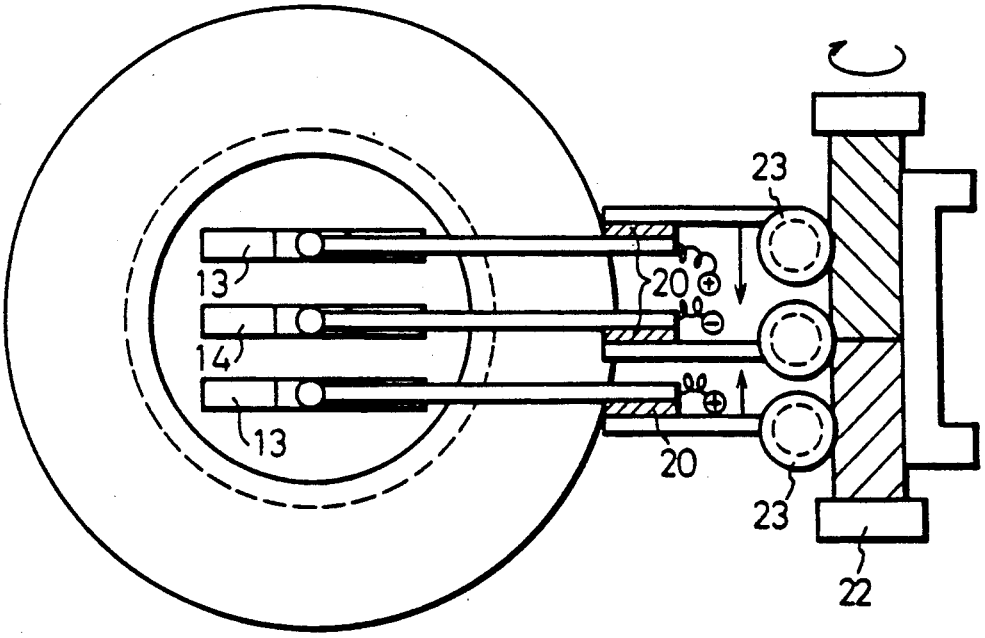

FIGS. 11a and 11B illustrate an electrolysis apparatus for use in carrying out the process of the present invention, wherein FIG. 11A is a longitudinal sectional diagram and Fig. 11B is a plane diagram. Each of a anode 13 and a cathode 14, immersed in an electrolysis bath 12, is a plate-shaped electrode. Two anodes 13 are arranged to confront the cathode 14 on both sides thereof with the cathode 14 in the center. Where the cathode 14 is formed of iron, the bottom side 15 of the cathode is tapered to have a projection at the center for dropping an Nd/Fe alloy from one point. The upper side of the electrolysis bath 12 is open to the air 16, and the inner wall face 17 of the cell is composed of austenitic stainless steel. The outside of the cell is constructed by an external heating furnace 18 having a heating element 19. Reference numeral 20 represents an insulating plate. The temperature of the electrolysis bath 12 is detected by a thermocouple 21 and the heating element 19 is controlled by an external heating furnace-controlling apparatus (not shown) to adjust the temperature of the electrolysis bath 12. The plate-shaped electrodes 13 and 14 are suspended from above and supported on an electrode-attaching stand 24 through an electrode distance-adjusting apparatus 22 and an electrode lifter 23. The electrode distance-adjusting apparatus 22 and electrode lifter 23 are of the worm gear system, and the electrodes 13 and 14 are moved horizontally and vertically by rotation of the worm gears. A receiver 25 for collecting Nd or an Nd alloy is arranged in the electrolytic cell, and the inner surface of the receiver 25 is lined with tantalum. In this apparatus, the upper side of the electrolysis bath is open to the air. Alternatively, the upper side of the electrolysis bath may be covered so that an atmosphere having a specific oxygen concentration can be located above the bath and utilized.

In this electrolysis apparatus, $NdF_3$ is used as the starting material and the electrolysis is carried out under predetermined bath composition, bath temperature, current and voltage conditions, and Nd or an Nd alloy is dropped from the cathode 14 and collected in the receiver 25. During the electrolysis, the electrodes are consumed and the distance between the electrodes is changed. Accordingly, by using the distance between the distance-adjusting apparatus 22, the electrodes are moved while taking the electrolysis conditions into consideration, so that the distance between the electrodes is kept constant, whereby desirable electrolysis conditions can be maintained.

The present invention will now be described with reference to the following examples.

Figure 12:
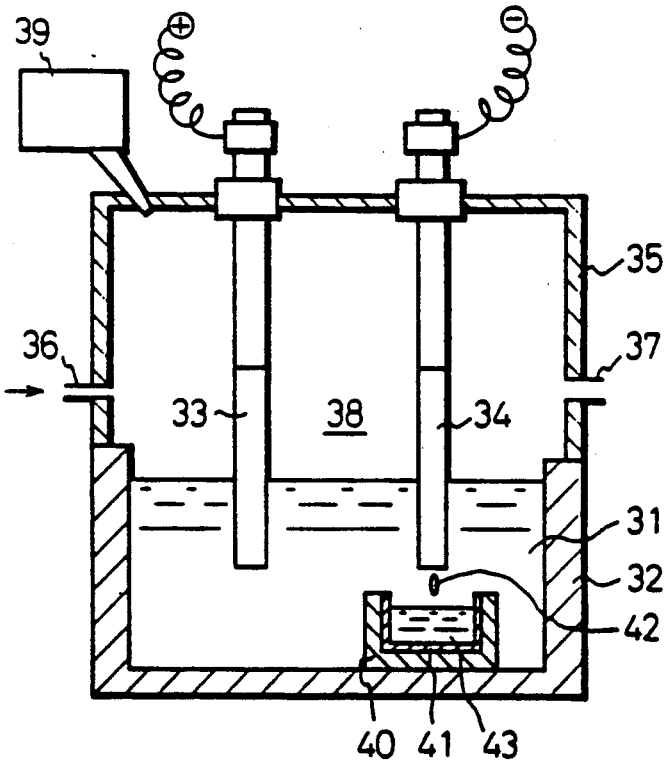
FIG. 12 is a sectional view illustrating diagrammatically an electrolysis apparatus used for the experiment in the examples.

In these examples, the electrolysis test was carried out in an electrolytic cell as shown in FIG. 12. Referring to FIG. 12, a fused salt 31 is charged in a lower cell 32 composed of iron, and a anode 33 and a cathode 34 are arranged to confront each other. The distance between the electrodes 30 is maintained at 30 mm and the depth of the electrolysis bath is adjusted to 20 cm. The upper side of the electrolytic cell 32 is covered with a lid 35 and an atmosphere gas is introduced from a gas inlet 36 (the gas can be discharged from a gas outlet 37, if necessary) to maintain a predetermined atmosphere 38. Note, the test in the open air is carried out while the lid 35 is removed. Note also, in FIG. 12, reference numeral 39 represents a material feeder, reference numeral 40 represents a receiver proper, and reference numeral 41 represents an inner liner (formed of tantalum) of the receiver. By this electrolysis, Nd is obtained in the form of a needle crystal, and an Nd alloy reacts with the cathode to form a liquid drop. The Nd or Nd alloy is deposited in the receiver 40 by the difference of the specific gravity or the current flow in the needle crystal (in FIG. 12, reference numeral 42 represents a liquid drop of Nd or an Nd alloy and reference numeral 43 represents Nd or an Nd alloy).

EXAMPLE 1 prior art

For comparison, a fused salt comprising 80 mole % (34.1% by weight) of LiF an 20 mole % (65.9% by weight) of $NdF_3$ was used, the upper portion of the electrolysis cell was filled with argon gas, and the electrolysis was carried out by using a rod-shaped graphite electrode (the graphitization ratio was 98%) as the anode and a rod-shaped electrolytic iron electrode (the carbon content was 0.02%), whereby an Nd/Fe alloy was prepared. Other electrolysis conditions and the results of the analysis of the obtained Nd/Fe alloy are shown in Table 1.

EXAMPLE 2 comparison

For comparison (not the prior art), the electrolysis was carried out under the same conditions as described in Example 1 except that plate-shaped electrodes were used as the anode and cathode. The results are shown in Table 1.

By using the plate-shaped electrodes, the critical current value was improved and the carbon content in the Nd/Fe alloy was slightly reduced. But, the current and voltage of the electrolysis bath were still unstable and the bath surface was fully covered with powdery carbon, and it was confirmed that the carbon content (1500 ppm) in the obtained Nd-Fe alloy was not suitable for using the alloy directly as the starting material (below 400 ppm) of a permanent magnet.

EXAMPLES 3 through 7

To examine the effect of the oxygen gas concentration in the atmosphere, the electrolysis was carried out under the same conditions as described in Example 2 except that a mixture of nitrogen and oxygen was used as the atmosphere gas and the oxygen concentration was changed.

The results are shown in Table 1.

As apparent from the results shown in Table 1, with an increase of the oxygen gas concentration in the atmosphere, powdery carbon on the bath surface was prominently reduced, and at an oxygen gas concentration of 20%, 40% or 50%, no powdery carbon was observed on the bath surface. Correspondingly, the carbon content in the obtained Nd/Fe alloy was reduced with an increase of the oxygen gas concentration in the atmosphere. Although the carbon concentration was 2000 ppm in the prior art process, at an oxygen gas concentration of 20%, 40% or 50% in the atmosphere, the carbon content was reduced to 40 ppm and the Nd/Fe alloy could be directly used as the starting material (below 400 ppm) for a permanent magnet.

Furthermore, at an oxygen gas concentration of, for example, 20% in the atmosphere, the critical current value (7 times) and the current efficiency (2.7 times) were greatly improved over the values obtained in the prior art process, the current, voltage, and critical current value were very stable, and the amount recovered of the Nd/Fe alloy was increased and 21 times the amount of the alloy recovered in the prior art process.

The above-mentioned effects were not prominent when the oxygen gas concentration in the atmosphere was low. On the other hand, it was confirmed that, if the oxygen gas concentration was increased beyond 30%, consumption of the carbon electrode became conspicuous and falling of the anode was accelerated.

EXAMPLES 8 through 10

The electrolysis was carried out at an oxygen concentration of 20% in the atmosphere while changing the shape and arrangement of the electrodes. In Example 8, rod-shaped electrodes were used, and in Example 9, a pair of plate-shaped electrodes were used, as the anode and cathode. In Example 10, a plate-shaped cathode was arranged at the center, and plate-shaped anodes were arranged in parallel to each other on both sides of the cathode.

The results are shown in Table 1.

If the shape of the electrode was changed to the plate (Example 9) from the rod (Example 8), the critical current value (4.7 times) and the current efficiency (1.3 times) were increased, and as a result, the amount of recovered Nd/Fe alloy was synergistically increased (7.2 times). Furthermore, if plate-shaped anodes were arranged on both sides of the plate-shaped cathode to confront the cathode, the critical current value was doubled and the current efficiency was slightly increased, compared with the case where one plate-shaped anode was used, and as a result, the amount of the recovered Nd/Fe alloy was increased more than 2 times. Moreover, by using plate-shaped electrodes, the carbon content in the Nd/Fe alloy was reduced. Still further, from the results of Examples 8 through 10, it was found that, if the oxygen concentration was adjusted to an appropriate level, the current and voltage could be stabilized during the electrolysis, regardless of the shape of the electrodes.

If Example 10 was compared with the prior art process (Example 1), in Example 10, the critical current value was increased 14 times, the current efficiency was increased 2.8 times, the amount of the recovered Nd/Fe alloy was increased 45 times, and the carbon content in the Nd/Fe alloy was reduced to 1/50.

TABLE 1

| | Prior Art Example 1 | Plate-Shaped Electrodes, Ar Atmosphere Example 2 | Effect of Oxygen Concentration Example 3 | Example 4 | Example 5 |
|---|---|---|---|---|---|
| Electrolysis Atmosphere | | | | | |
| Ar (vol %) | 100 | 100 | 0 | 0 | 0 |
| $N_2$ (vol %) | — | — | 95 | 90 | 80 |
| $O_2$ (vol %) | — | — | 5 | 10 | 20 |
| Shape and Material of Electrode | | | | | |
| anode (A) of graphite | rod | plate | plate | plate | plate |
| cathode of iron | rod | plate | plate | plate | plate |
| anode (B) of graphite | not | not | not | not | not |
| Size of Electrode (portion in bath) | | | | | |
| anode (A) (cm) | $5\phi \times 10^H$ | $14^W \times 10^H \times 2^D$ | $14^W \times 10^H \times 2^D$ | $14^W \times 10^H \times 2^D$ | $14^W \times 10^H \times 2^D$ |
| cathode (cm) | $5\phi \times 10^H$ | $14^W \times 10^H \times 2^D$ | $14^W \times 10^H \times 2^D$ | $14^W \times 10^H \times 2^D$ | $14^W \times 10^H \times 2^D$ |
| anode (B) (cm) | not | not | not | not | not |
| Size of Electrolytic Cell (cm) | $18\phi \times 25^H$ | $18\phi \times 25^H$ | $18\phi \times 25^H$ | $18\phi \times 25^H$ | $18\phi \times 25^H$ |
| Composition of Fused Salt | | | | | |
| LiF (mole %) | 80 | 80 | 80 | 80 | 80 |
| $NdF_3$ (mole %) | 20 | 20 | 20 | 20 | 20 |
| $Nd_2O_3$ (% by weight) | 0 | 0 | 0 | 0 | 0 |
| Electrolysis Temperature (C.) | 880 | 880 | 880 | 880 | 880 |
| Results of Electrolysis | | | | | |
| critical current value (A) | 40 | 100 | 100 | 200 | 280 |
| electrolysis time (Hr) | 5 | 5 | 5 | 5 | 5 |
| average voltage (V) | 6 | 6 | 6 | 7 | 7 |
| average current (A) | 30 | 80 | 80 | 160 | 240 |
| average anode current density ($A/cm^2$) | (0.2) | 0.6 | 0.6 | 1.1 | 1.7 |
| average cathode current density ($A/cm^2$) | (0.2) | 0.6 | 0.6 | 1.1 | 1.7 |
| stability of current and voltage | unstable | unstable | unstable | unstable | stable |
| generation of carbon on bath surface | very large | very large | very large | large | not |
| consumption of carbon above bath | not | not | not | some but no problem | some but no problem |
| stability of critical current value | unstable | unstable | unstable | unstable | stable |
| amount of recovered Nd—Fe (g) | 95 | 421 | 421 | 1011 | 2022 |
| Nd content (%) | 85 | 85 | 85 | 85 | 85 |
| current efficiency (%) | 30 | 50 | 50 | 60 | 80 |
| C concentration (ppm) | 2000 | 1500 | 1500 | 500 | 40 |
| O concentration (ppm) | 2400 | 2000 | 2000 | 500 | 70 |
| Others | no isolation of | no isolation of anode | no isolation of anode | no isolation of anode | no isolation of anode |

TABLE 1-continued

| | anode | | | | |
|---|---|---|---|---|---|
| | Effect of Oxygen Concentration | | Effect of Shape of Electrode | | |
| | Example 6 | Example 7 | Example 8 | Example 9 | Example 10 |
| Electrolysis Atmosphere | | | | | |
| Ar (vol %) | 0 | 0 | 0 | 0 | 0 |
| $N_2$ (vol %) | 60 | 50 | 80 | 80 | 80 |
| $O_2$ (vol %) | 40 | 50 | 20 | 20 | 20 |
| Shape and Material of Electrode | | | | | |
| anode (A) of graphite | plate | plate | rod | plate | plate |
| cathode of iron | plate | plate | rod | plate | plate |
| anode (B) of graphite | not | not | not | not | plate |
| Size of Electrode (portion in bath) | | | | | |
| anode (A) (cm) | $14^W \times 10^H \times 2^D$ | $14^W \times 10^H \times 2^D$ | $5\phi \times 10^H$ | $14^W \times 10^H \times 2^D$ | $14^W \times 10^H \times 2^D$ |
| cathode (cm) | $14^W \times 10^H \times 2^D$ | $14^W \times 10^H \times 2^D$ | $5\phi \times 10^H$ | $14^W \times 10^H \times 2^D$ | $14^W \times 10^H \times 2^D$ |
| anode (B) (cm) | not | not | not | not | $14^W \times 10^H \times 2^D$ |
| Size of Electrolytic Cell (cm) | $18\phi \times 25^H$ | $18\phi \times 25^H$ | $18\phi \times 25^H$ | $18\phi \times 25^H$ | $18\phi \times 25^H$ |
| Composition of Fused Salt | | | | | |
| LiF (mole %) | 80 | 80 | 80 | 80 | 80 |
| $NdF_3$ (mol %) | 20 | 20 | 20 | 20 | 20 |
| $Nd_2O_3$ (% by weight) | 0 | 0 | 0 | 0 | 0 |
| Electrolysis Temperature (C.) | 880 | 880 | 880 | 880 | 880 |
| Results of Electrolysis | | | | | |
| critical current value (A) | 280 | 280 | 60 | 280 | 560 |
| electrolysis time (Hr) | 4 | 1 | 5 | 5 | 5 |
| average voltage (V) | 7 | 7 | 6 | 7 | 8 |
| average current (A) | 240 | 240 | 45 | 240 | 480 |
| average anode current density ($A/cm^2$) | 1.7 | 1.7 | (0.3) | 1.7 | 1.7 |
| average cathode current density ($A/cm^2$) | 1.7 | 1.7 | (.03) | 1.7 | 3.4 |
| stability of current and voltage | stable | stable | stable | stable | stable |
| generation of carbon on bath surface | not | not | not | not | not |
| consumption of carbon above bath | large | very large | some but no problem | some but no problem | some but no problem |
| stability of critical current value | stable | stable | stable | stable | stable |
| amount of recovered Nd—Fe (g) | 1415 | 303 | 280 | 2020 | 4296 |
| Nd content (%) | 85 | 85 | 85 | 85 | 85 |
| current efficiency (%) | 70 | 60 | 60 | 80 | 85 |
| C concentration (ppm) | 40 | 40 | 100 | 40 | 40 |
| O concentration (ppm) | 200 | 500 | 200 | 70 | 70 |
| Others | anode isolated in 4 hours | anode isolated in 1 hour | no isolation of anode | no isolation of anode | no isolation of anode |

EXAMPLES 11 and 12

The electrolysis was carried out under the same conditions as described in Examples 1 and 10 except that an electrolysis bath comprising 80 mole % (33.4% by weight) of LiF, 20 mole % (64.6% by weight) of $NdF_3$ and 2% by weight of $Nd_2O_3$ was used.

The results are shown in Table 2. It was seen that there was no difference in the effect of the present invention between the bath of the LiF-$NdF_3$ system and the bath of the LiF-$NdF_3$-$Nd_2O_3$ system.

EXAMPLES 13 and 14

The electrolysis was carried out under the same conditions as described in Examples 1 and 10 except that a graphite electrode was used as the cathode.

The results are shown in Table 2. It was confirmed that, in the production of Nd, the same effect as attained in the production of the Nd/Fe alloy was attained.

EXAMPLES 15 and 16

The electrolysis was carried out under the same conditions as described in Example 10 except that the upper side of the electrolysis bath was opened to the air and a graphite electrode (Example 15) or an iron electrode (Example 16) was used as the cathode.

The results are shown in Table 2. It was confirmed that, even in the air, the effect of the present invention was attained.

EXAMPLE 17

The electrolysis was carried out under the same conditions as described in Example 10 except that a rod-shaped electrode ($5\phi \times 10$ H) was used as the cathode.

The results are shown in Table 2. It was confirmed that, even if a plate-shaped electrode was used only as the anode, a desired effect was attained.

EXAMPLES 18 and 19

The comparative experiments were carried out under the same conditions as described in Example 10 except that plate-shaped electrodes having a width of 70 mm (Example 18) or 140 mm (Example 19) were used.

The results are shown in Table 2. From the results shown in Table 2, it was found that if the effective area of the electrodes was increased, the current value and the output of the Nd/Fe alloy were proportionally increased. Therefore, it is understood that the present invention is superior to the prior art process using rod-shaped electrodes, in that electrodes having a larger effective area can be used in the same electrolytic cell.

Figure 13:
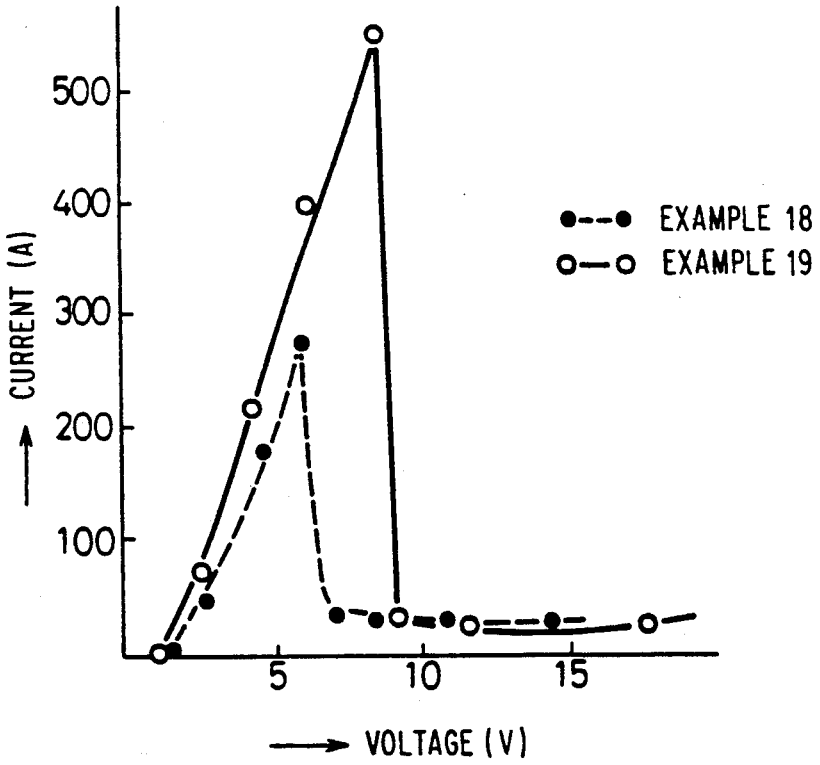
FIG. 13 is a diagram illustrating the relationship between the voltage and current observed in Examples 18 and 19.

FIG. 13 shows current-voltage curves at the electrolysis, obtained in Examples 18 and 19. From FIG. 13, it is understood, at the same current value, the voltage in Example 19 was lower than the voltage in Example 18.

TABLE 2

| | $LiF—NdF_3—Nd_2O_3$ System | | Production of Metallic Nd by Graphite Cathode | |
|---|---|---|---|---|
| | Example 11 | Example 12 | Example 13 | Example 14 |
| Electrolysis Atmosphere | | | | |
| Ar (vol %) | 100 | 0 | 100 | 0 |
| $N_2$ (vol %) | — | 80 | — | 80 |
| $O_2$ (vol %) | — | 20 | — | 20 |
| Shape and Material of Electrode | | | | |
| anode (A) | graphite, rod | graphite, plate | graphite, rod | graphite, plate |
| cathode | iron, rod | iron, plate | graphite, rod | graphite, plate |
| anode (B) | not | graphite, plate | not | graphite, plate |
| Size of Electrode (portion in bath) | | | | |
| anode (A) (cm) | $5\phi \times 10^H$ | $14^W \times 10^H \times 2^D$ | $14^W \times 10^H \times 2^D$ | $14^W \times 10^H \times 2^D$ |
| cathode (cm) | $5\phi \times 10^H$ | $14^W \times 10^H \times 2^D$ | $14^W \times 10^H \times 2^D$ | $14^W \times 10^H \times 2^D$ |
| anode (B) (cm) | not | $14^W \times 10^H \times 2^D$ | not | $14^W \times 10^H \times 2^D$ |
| Size of Electrolytic Cell (cm) | $18\phi \times 25^H$ | $18\phi \times 25^H$ | $18\phi \times 25^H$ | $18\phi \times 25^H$ |
| Composition of Fused Salt | | | | |
| LiF (mole %) | 80 | 80 | 80 | 80 |
| $NdF_3$ (mole %) | 20 | 20 | 20 | 20 |
| $Nd_2O_3$ (% by weight) | 2 | 2 | 0 | 0 |
| Electrolysis Temperature (C.) | 880 | 880 | 880 | 880 |
| Results of Electrolysis | | | | |
| critical current value (A) | 40 | 560 | 45 | 600 |
| electrolysis time (Hr) | 5 | 5 | 5 | 5 |
| average voltage (V) | 6 | 8 | 6 | 7 |
| average current (A) | 30 | 480 | 35 | 510 |
| average anode current density ($A/cm^2$) | (0.2) | 1.7 | (0.2) | 1.8 |
| average cathode current density ($A/cm^2$) | (0.2) | 3.4 | (0.2) | 3.6 |
| stability of current and voltage | unstable | stable | unstable | stable |
| generation of carbon on bath surface | very large | not | very large | not |

TABLE 2-continued

| | | | | |
|---|---|---|---|---|
| consumption of carbon above bath | not | some but no problem | not | some but no problem |
| stability of critical current value | unstable | stable | unstable | stable |
| amount of recovered Nd (g) | — | — | 79 | 3460 |
| amount of received Nd—Fe (g) | 95 | 4296 | — | — |
| Nd content (%) | 85 | 85 | 99 | 99 |
| current efficiency (%) | 30 | 85 | 25 | 75 |
| C concentration (ppm) | 2000 | 40 | | |
| O concentration (ppm) | 2400 | 70 | | |
| Others | no isolation of anode | no isolation of anode | no isolation of anode | no isolation of anode |

| | Production of Nd/Fe and Nd in Air | | Effect by Plate-Shaped Anode | Effect by Electrode Area | |
|---|---|---|---|---|---|
| | Example 15 | Example 16 | Example 17 | Example 18 | Example 19 |
| Electrolysis Atmosphere | | | | | |
| Ar (vol %) | | | 0 | 0 | 0 |
| $N_2$ (vol %) | in air | in air | 80 | 80 | 80 |
| $O_2$ (vol %) | | | 20 | 20 | 20 |
| Shape and Material of Electrode | | | | | |
| anode (A) | graphite, plate | graphite, plate | graphite, plate | graphite, plate | graphite, plate |
| cathode | graphite, plate | iron, plate | iron, rod | iron, plate | iron, plate |
| anode (B) | graphite, plate | graphite, plate | not | graphite, plate | graphite, plate |
| Size of Electrode (portion in bath) | | | | | |
| anode (A) (cm) | $14^W \times 10^H \times 2^D$ | $14^W \times 10^H \times 2^D$ | $14^W \times 10^H \times 2^D$ | $7\phi \times 10^H \times 2^D$ | $14^W \times 10^H \times 2^D$ |
| cathode (cm) | $14^W \times 10^H \times 2^D$ | $14^W \times 10^H \times 2^D$ | $5\phi\ 10^H$ | $7\phi \times 10^H \times 2^D$ | $14^W \times 10^H \times 2^D$ |
| anode (B) (cm) | $14^W \times 10^H \times 2^D$ | $14^W \times 10^H \times 2^D$ | not | $7\phi \times 10^H \times 2^D$ | $14^W \times 10^H \times 2^D$ |
| Size of Electrolytic Cell (cm) | $18\phi \times 25^H$ | $18\phi \times 25^H$ | $18\phi \times 25^H$ | $18\phi \times 25^H$ | |
| Composition of Fused Salt | | | | | |
| LiF (mole %) | 80 | 80 | 80 | 80 | 80 |
| $NdF_3$ (mole %) | 20 | 20 | 20 | 20 | 20 |
| $Nd_2O_3$ (% by weight) | 0 | 0 | 0 | 0 | 0 |
| Electrolysis Temperature (C.) | 880 | 880 | 880 | 880 | 880 |
| Results of Electrolysis | | | | | |
| critical current value (A) | 600 | 560 | 250 | 280 | 560 |
| electrolysis time (Hr) | 5 | 5 | 5 | 5 | 5 |
| average voltage (V) | 7 | 8 | 7 | 6 | 8 |
| average current (A) | 510 | 480 | 200 | 240 | 480 |
| average anode current density ($A/cm^2$) | 1.8 | 1.7 | (1.4) | 1.7 | 1.7 |
| average cathode current density ($A/cm^2$) | 3.6 | 3.4 | (1.3) | 3.4 | 3.4 |
| stability of current and voltage | stable | stable | stable | slightly unstable | stable |
| generation of carbon on bath surface | not | not | not | not | not |
| consumption of carbon above bath | some but no problem | some but no problem | some but no problem | some but no problem | some but no problem |
| stability of critical current value | stable | stable | slightly unstable | stable | stable |
| amount of recovered Nd (g) | 3460 | — | — | — | — |
| amount of received | — | 4296 | 1474 | 2148 | 4296 |

TABLE 2-continued

| | | | | | |
|---|---|---|---|---|---|
| Nd—Fe (g) | | | | | |
| Nd content (%) | 99 | 85 | 85 | 85 | 85 |
| current efficiency (%) | 75 | 85 | 70 | 85 | 85 |
| C concentration (ppm) | | 40 | 40 | 40 | 40 |
| O concentration (ppm) | | 70 | 70 | 70 | 70 |
| Others | no isolation of anode | no isolation of anode | no isolation of anode | no isolation of anode | no isolation of anode |

EXAMPLE 20

Various materials as the material for the fused salt bath cell were subjected to the corrosion test.

Figure 14:
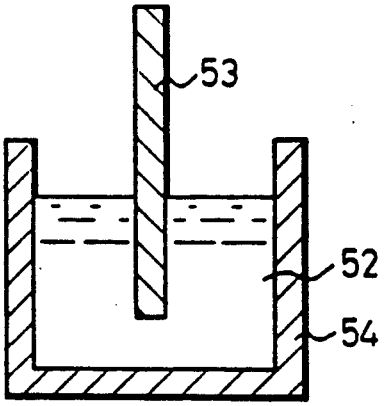
FIG. 14 is a sectional view illustrating a method for testing the corroding properties of various iron alloys in the examples.
Figure 15:
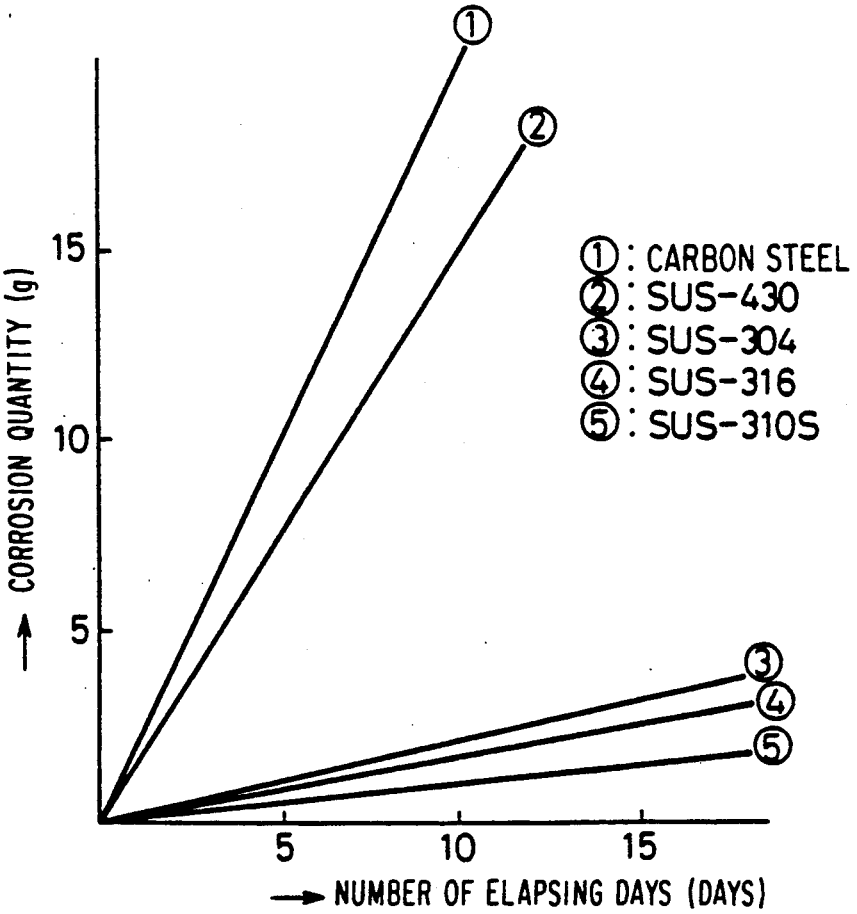
FIG. 15 is a graph illustrating the results of the corrosion tests conducted according to the method shown in FIG. 14; and, FIG. 16 is a sectional diagram illustrating an electrolysis apparatus used in the durability test of electrolytic cells.

FIG. 14 shows an apparatus used for the corrosion test of various materials (carbon steel, and SUS-304, SUS-316, SUS-310S and SUS-430 of JIS standards) in the fused salt. The results are shown in FIG. 15.

As shown in FIG. 14, the material 53 to be tested was placed into the fused salt 52. The sum of the corrosion quantities in the fused salt, on the interface between the fused salt and the open air and above the fused bath was examined with the lapse of time. The results are shown in FIG. 15

The experiment was conducted in the open air by using a bath cell 54 formed of SUS-304 and maintaining the bath temperature at 880° C. without supplying an electric current.

A fused salt of the LiF-$NdF_3$ system comprising 80 mole % of LiF and 20 mole % of $NdF_3$ and a fused salt of the LiF-$NdF_3$-$Nd_2O_3$ system formed by adding 2% by weight of $Nd_2O_3$ to the LiF-$NdF_3$ system comprising 80 mole % of LiF and 20 mole % of $NdF_3$ were used as the fused bath 52. Similar results were obtained.

From FIG. 15, it is seen that, in ordinary carbon steel and ferritic stainless steel (SUS-430), the corrosion quantity was larger than in austenitic stainless steels (SUS-304, SUS-316 and SUS-310S), and austenitic stainless steels were excellent. Furthermore, it is seen that, among austenitic stainless steels, SUS-310S (comprising 25% by weight of Cr and 20% by weight of Ni) had the best corrosion resistance.

EXAMPLES 21 and 22

Figure 16:
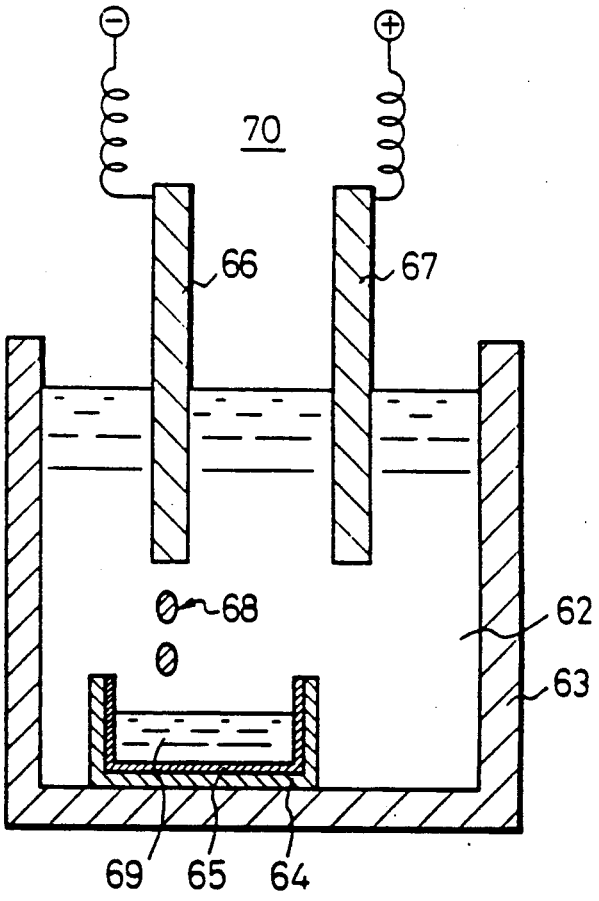

Based on the results obtained in Example 18, an electrolytic cell shown in FIG. 16 was fabricated and the test of the continuous operation of preparing Nd/Fe was carried out.

Referring to FIG. 16, an electrolytic cell 63 for containing a fused salt 62 was fabricated by using SUS-310S based on the above-mentioned test results (Example 21), and for comparison, the electrolytic cell was fabricated by using ordinary carbon steel (Example 22). In FIG. 16, the inner side of a metal-receiving vessel 64 composed of SUS-310S was lined with Ta 65 because of high alloying reactivity of Nd with other metals.

When a cathode 66 of iron and an anode 67 of graphite were arranged and an electric current was supplied, Nd formed by the electrolysis reacted with the cathode 66 to form an Nd/Fe alloy liquid drop 68, the liquid drop was received in the metal-receiving vessel 64, and an Nd/Fe alloy 69 was deposited. Note, the electrolysis was conducted in air 70.

In each of the two electrolysis baths, that is, the LiF-$NdF_3$ system comprising 80 mole % of LiF and 20 mole % of $NdF_3$ and the LiF-$NdF_3$-$Nd_2O_3$ system formed by adding 2% by weight of $Nd_2O_3$ to the LiF-$NdF_3$ system comprising 80 mole % of LiF and 20 mole % of $NdF_3$, the operation was carried out at an electrolysis temperature of 880° C. No substantial difference was brought about by the difference of the bath composition.

The results are shown in Table 3. The operation was continuously conducted, and the thickness of the material used for the electrolytic cell was reduced. The number of the operation days means the elapsing days until the thickness was reduced to a small value such that the electrolysis bath would flow out as the electrolysis operation continued. In each run, the thickness of the used cell material was 5 mm.

TABLE 3

| | Example 21 | Example 22 |
|---|---|---|
| Material Used | ordinary carbon steel | SUS-310S |
| Atmosphere | in air | in air |
| Composition of Fused Salt | | |
| LiF (mole %) | 80 | 80 |
| $NdF_3$ (mole %) | 20 | 20 |
| $Nd_2O_3$ (% by weight) | 0–2 | 0–2 |
| Electrolysis Temperature (°C.) | 880 | 880 |
| Average Current (A) | 240 | 240 |
| Average Voltage (V) | 7 | 7 |
| Number of Continuous Use Days (days) | 15 | 150 |

From the results shown in Table 3, it was confirmed that the number of continuous use days was drastically increased by using SUS-310S, i.e., austenitic stainless steel.

I claim:

1. A process for the preparation of neodymium or neodymium-iron alloy, which comprises arranging a plate shape carbon electrode as an anode and a plate shaped metal or carbon electrode as a cathode in a fused salt electrolysis bath so that the electrodes confront each other in the electrolysis bath, and performing the electrolysis at an anode current density of at least $0.7A/cm^2$ to deposit neodymium or a neodymium-iron alloy on the cathode and drop the neodymium or neodymium-iron alloy below the cathode to collect the neodymium or neodymium-iron alloy at the bottom of the electrolysis bath.

* * * * *